US005185909A

United States Patent [19]

Inagaki

[11] Patent Number: 5,185,909

[45] Date of Patent: Feb. 16, 1993

[54] ZIPPER FOR CLOSING THE MOUTH OF A BAG

[76] Inventor: Hiromichi Inagaki, 1-143, Aza Maedaomote, Inuyama-shi, Aichi-ken, Japan

[21] Appl. No.: 706,295

[22] Filed: May 28, 1991

[51] Int. Cl.[5] ..... A44B 19/00; A44B 33/00

[52] U.S. Cl. ..... 24/587; 24/304; 24/576; 383/63

[58] Field of Search ..... 24/304, 399, 398, 384, 24/389, 405, 453, 576, 587, DIG. 11; 383/63, 65; 248/205.3

[56] References Cited

U.S. PATENT DOCUMENTS

| | | | |
|---|---|---|---|
| 2,532,011 | 11/1950 | Dahlquist et al. | 24/DIG. 11 |
| 2,750,315 | 6/1956 | Tierney | 24/DIG. 11 |
| 2,975,538 | 3/1961 | Murfin | 24/304 |
| 3,542,321 | 11/1970 | Kahabka | 248/205.3 |
| 4,310,137 | 1/1982 | Frye | 248/205.3 |
| 4,691,373 | 9/1987 | Ausnit | 24/576 |
| 4,731,911 | 3/1988 | Gould | 24/587 |
| 4,756,498 | 7/1988 | Frye | 248/205.3 |
| 4,906,494 | 3/1990 | Babinec et al. | 383/63 |

FOREIGN PATENT DOCUMENTS

| | | | |
|---|---|---|---|
| 2080412 | 2/1982 | United Kingdom | 24/304 |

*Primary Examiner*—Victor N. Sakran
*Attorney, Agent, or Firm*—McGlew and Tuttle

[57] ABSTRACT

A zipper for closing the mouth of a bag that is formed by a groove on an internal face of tape, on one side, and a rib to be fitted to the groove on another internal face of the tape, on the other side. A bonding agent layer is provided on the outer side of the respective tapes and pastes a parting pattern paper on the outside of these bonding agent layers. This zipper, even if it is made of a substance which lacks heat sealing properties between the inner face of the bag and the zipper, can be attached easily to the inside mouth of the bag by pasting up the bonding agent covered by the parting pattern paper, to the inner face of mouth of the bag, by stripping the said parting pattern paper.

13 Claims, 2 Drawing Sheets

ZIPPER FOR CLOSING THE MOUTH OF A BAG

BACKGROUND OF THE INVENTION

The present invention relates to a zipper that has been molded of plastic and is used for closing the mouth of a bag.

Such a zipper made of resin may be made with a structure where it is to be nipped, for its attachment, into the portion corresponding to the mouth of bag during bag-making and during automatic packing.

In this attachment, both the elements (bag and zipper) can be attached through their fusion by a heat sealing method if the bag side and the zipper side possesses the property allowing heat fusion.

However, if both the elements do not exhibit such a heat fusion property, a film having the heat fusion property with the bag side is pasted up to the outside of zipper tape, or a film having the heat fusion property with the zipper tape is pasted up to the bag side. Or, if this type of structure is not adopted, a bonding agent is coated to the adhesive face on each of such occasions for pasting them up to each other.

However, the attachment method of the zipper involves problems as follows.

a. The zipper tape needs to have the thickness of at least some 150μ in order to prevent its melting during the fusion step.

b. In the event that the heat fusion film is to be pasted up to the outside of zipper tape, its thickness is increased by this film portion.

c. Because the thickness of zipper entirety is increased by such items "a" and "b", the heat sealing property deteriorates in the portion of crossing the zipper when side-sealing the bag, which becomes the cause for pin holes.

d. The pasting method with use of the bonding agent is complex in the process and at the same time is difficult with respect to quality control.

SUMMARY AND OBJECTS OF THE INVENTION

It is an object of this invention to present a zipper that can be attached by another method than the heat sealing method in the event that the material of the zipper tape differs from the material of inner face of the bag.

According to the invention, a zipper formed of resin is provided which has been structured to include a rib member and a groove member, each of these members being formed on an inner face of zipper tape. These members may be provided engaged with each other. The zipper tape is provided with a bonding agent coated on an outer face with the addition of parting pattern paper applied on the outside of this bonding agent coated face. The parting pattern paper may be removed from the bonding agent such that the tape face with bonding agent may be applied to the interior of a bag or the like.

A further object of the invention is to provide a structure for easily bonding zipper elements as described above and a process for feeding zipper elements with bonded surfaces and parting pattern paper, removing the paper and applying portions of the zipper to bags or the like.

Still another object of the invention is to provide a zipper structure which may be applied to bags or the like and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
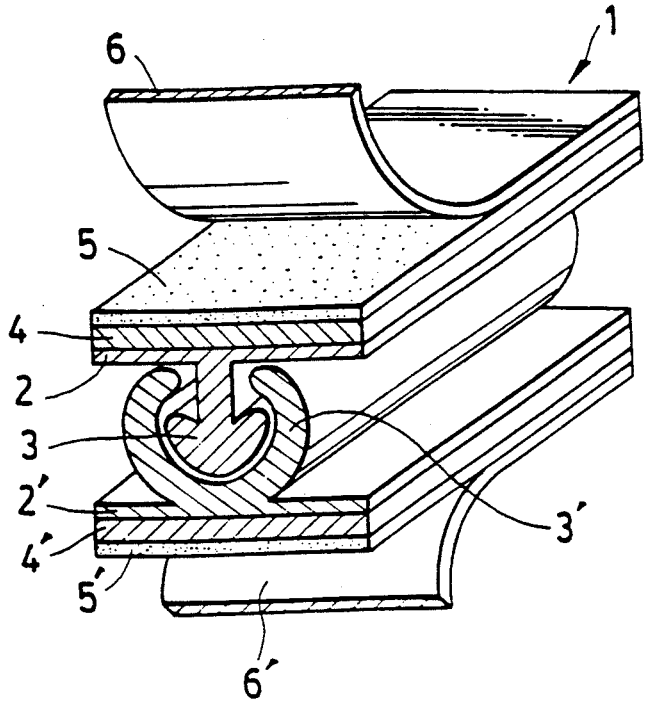
FIG. 1 shows the situation where the zipper according to this invention has been cut in cross section and its parting pattern paper has been stripped a bit.

Referring to the drawings and in particular to FIG. 1, the structure of an inventive zipper generally designated 1 is shown including a rib 3 and a groove 3'. The rib 3 and the groove 3' are formed on an inner face of the zipper tapes 2 and 2'. According to a preferred form of the invention, nylon tape 4 and 4' are applied or pasted to the outside of the zipper tapes 2 and 2'. Additionally, a bonding agent is applied as shown in FIG. 1 with the applied bonding agents 5 and 5' which coat the outside of the tape 2, 4 and 2', 4'. A parting paper or parting pattern paper (groove protective) 6 and 6' are applied or fixed (pasted) to the outside of the bonding agent 5 and the bonding agent 5', respectively. According to a preferred form of the invention, the zipper tape 2 and 2', the rib 3 and the groove 3' are all made of polyethylene. The zipper tape 2 and the zipper tape 2' preferably have a thickness of 40μ while the nylon tape 4 and 4' are provided with a thickness of 12μ.

Figure 2:
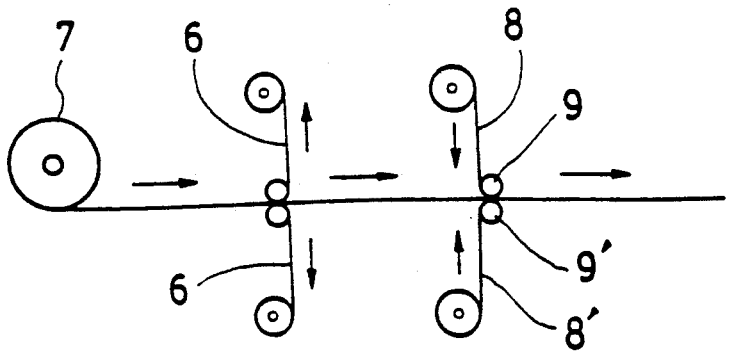
FIG. 2 is an explanatory drawing in the status where the zipper has been unrolled out of the roller, the parting pattern paper has first been stripped and then the zipper has been inserted into the mouth of bag.
Figure 3:
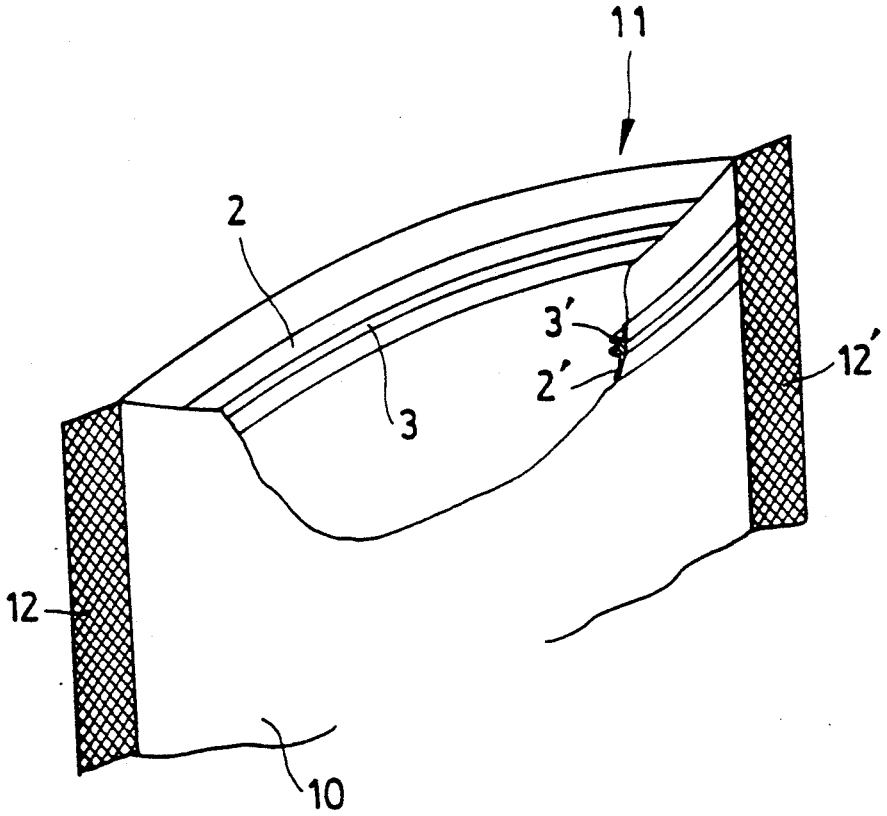
FIG. 3 is a cutaway perspective view of the mouth portion of bag to which the zipper has been attached.

The zipper of the aforesaid structure is rolled up to the roller 7 with the rib 3 and the groove /rib engaged to each other as shown in FIG. 2, unrolled out of the said roller 7 during the bag making, and at a midway location the parting pattern papers 6 and 6' is stripped from each side. The tapes are then inserted between the films 8 and 8' on the side of the bag and pressed between the rollers 9 and 9'. FIG. 3 illustrates the situation where the bag has been made and the zipper 1 has been attached to the inside of mouth of bag in the manner described above. In FIG. 3, numeral 10 is the bag. Numeral 11 is the mouth of this bag 10 and numerals 12 and 12' are the side seals of bag 10.

The present invention consists of the structure and method as discussed above. This structure and method provides advantages as follows.

a. In the case of pushing out the rib and the groove for their fusion on to the surface of zipper tape, the rib and the groove can be previously fused to the tape inclusive of the parting pattern paper, and hence the strength of the entirety including the tape can be enhanced. As a result, the zipper itself can be made thin to some ⅓ as compared with the conventional zipper.

b. Because the zipper tape after the parting pattern paper has been stripped is thin in its tape portion, the side sealing of the bag can be done to a full extent thereby causing no pin holes, etc.

c. The zipper can be attached to the bag made of any material only by stripping the parting pattern paper.

d. In the case of the bag having no heat fusion property against the zipper, the compatible films have conventionally been pasted up to the zipper side or (and) the bag side for the provision of compatibility, but there is no need for this according to the invention, resulting in a lower cost of manufacture.

e. The zipper can be rolled up on a roller because the bonding agent of zipper is protected by the parting pattern paper, and quality control of zipper can also be made easier because the bonding performance is stable.

f. This zipper is convenient because the existing bag can be improved to the bag with zipper by attaching the zipper to the bag and because the zipper can be utilized for combining the articles to each other.

While a specific embodiment of the invention has been shown and described in detail to illustrate the application of the principles of the invention, it will be understood that the invention may be embodied otherwise without departing from such principles.

What is claimed is:

1. A zipper arrangement for connection with an element to be closed, comprising: a first tape element formed of resin, said first tape element having a rib formed on an inner face; a second tape element formed of resin, said second tape element having a groove formed on an inner face, said rib and groove being engaged with each other to form a closed zipper arrangement; a first tape backer provided on an outer surface of said first tape element and a second tape backer provided on an outer face of said second tape element; a bonding agent coated on an outer surfaces of said first tape backer and a bonding agent coated on an outer face of said second tape backer, said outer surface of said first tape element and said outer surface of said second tape element facing in opposite directions; and parting paper disposed on each of said bonding agent on said outer face of said first tape backer and said bonding agent on said outer face of said second tape backer.

2. A zipper arrangement according to claim 1 further comprising two spaced apart films adhered to said outer surface of said first and second tape elements, said two films being closed at an end opposite said first and second tape elements, two spaced apart side seals extending from said first and second tape elements to said end thereby forming a bag.

3. A zipper arrangement according to claim 1 further comprising two spaced apart films adhered to said outer surface of said first and second tape elements, said two films being closed at an end opposite said first and second tape elements, two spaced apart side seals extending from said first and second tape elements to said end thereby forming a bag.

4. Zipper arrangement according to claim 1 wherein said first tape backer element and said second tape backer element are formed of nylon.

5. A zipper arrangement according to claim 1 further comprising two spaced apart films adhered to said outer surface of said first and second tape elements, said two films being closed at an end opposite said first and second tape elements, two spaced apart side seals extending from said first and second tape elements to said end thereby forming a bag.

6. A method of providing a zipper for manufacturing a closable item, comprising the steps of:

providing a first tape element formed of resin with an inner face forming a rib and with a first tape element outer face;

providing a second tape element formed of resin with an inner face forming a groove and with a second tape element outer face;

engaging said rib and groove to form a closed zipper element and thereby facing said first tape element outer face in a direction which is opposite to the direction said second tape element faces;

applying a bonding agent to said first tape element outer face;

applying a bonding agent to said second tape element outer face;

applying a parting paper element to said bonding agent on each of said first and second tape element outer faces forming a roll of said zipper element with applied parting paper;

and unwinding said tape with applied parting paper and feeding said tape to a first location wherein said parting paper is removed from said closed zipper element and feeding said tape with parting paper removed to a second location wherein said closed zipper element is feed between two spaced apart film elements and adhered thereon.

7. A method according to claim 6, further comprising forming a roll of said zipper element with applied parting paper.

8. A method according to claim 7, wherein said roll is unwound and said tape with applied parting paper is fed to a first location wherein said parting paper is removed from said closed zipper element and fed to a second location wherein said closed zipper element is fed between two spaced apart films and adhered there between.

9. A method according to claim 8 further comprising the step of sealing said plastic sheets along transverse lines extending away from said zipper element and providing a closed end opposite said zipper element thereby forming a bag.

10. A method according to claim 8 further comprising the step of sealing said plastic sheets along transverse lines extending away from said zipper element and providing a closed end opposite said zipper element thereby forming a bag.

11. A method according to claim 8 further comprising the step of sealing said plastic sheets along transverse lines extending away from said zipper element providing a closed end opposite said zipper element thereby forming a bag; and providing a nylon tape backer element between said bonding agent and said outer face of each of said first and second tape element.

12. A method according to claim 6, wherein a nylon tape element is positioned between said bonding agent and each of said first and second tapes.

13. A zipper arrangement for connection with an element to be closed, comprising: a first tape element formed of resin, said first tape element having a rib formed on an inner face; a second tape element formed of resin, said second tape element having a groove formed on an inner face, said rib and groove being engaged with each other to form a closed zipper arrangement; a first nylon tape backer provided on an outer surface of said first tape element and a second nylon tape backer provided on an outer face of said second tape element; a bonding agent coated on an outer surface of said first tape backer and a bonding agent coated on an outer face of said second tape backer, said outer surface of said first tape backer and said outer surface of said second element facing in opposite directions; and parting paper disposed on each of said bonding agent on said outer face of said first tape element and said bonding agent on said outer face of said second tape element.

* * * * *